US009135895B2

(12) United States Patent
Irimura

(10) Patent No.: US 9,135,895 B2
(45) Date of Patent: Sep. 15, 2015

(54) FALLBOARD ARRANGEMENT FOR KEYBOARD INSTRUMENT

(71) Applicant: KABUSHIKI KAISHA KAWAI GAKKI SEISAKUSHO, Hamamatsu-shi, Shizuoka-ken (JP)

(72) Inventor: Kohtaro Irimura, Hamamatsu (JP)

(73) Assignee: KABUSHIKI KAISHA KAWAI GAKKI SEISAKUSHO, Hamamatsu-shi (JP)

( * ) Notice: Subject to any disclaimer, the term of this patent is extended or adjusted under 35 U.S.C. 154(b) by 103 days.

(21) Appl. No.: 13/869,698

(22) Filed: Apr. 24, 2013

(65) Prior Publication Data

US 2013/0283994 A1 Oct. 31, 2013

(30) Foreign Application Priority Data

Apr. 25, 2012 (JP) ..... 2012-100268

(51) Int. Cl.
*G10C 3/02* (2006.01)

(52) U.S. Cl.
CPC ..... *G10C 3/02* (2013.01)

(58) Field of Classification Search
USPC ..... 84/179
See application file for complete search history.

(56) References Cited

U.S. PATENT DOCUMENTS 6,353,163 B2 * 3/2002 Suzuki ..... 84/179

FOREIGN PATENT DOCUMENTS

JP 2000-305556 11/2000

* cited by examiner

*Primary Examiner* — Christopher Uhlir
(74) *Attorney, Agent, or Firm* — Christie, Parker & Hale, LLP

(57) ABSTRACT

A fallboard arrangement for a keyboard instrument, including a slide-type fallboard and enabling enhancing the degree of freedom of design while ensuring good appearance and smooth opening and closing operation of the fallboard, to improve marketability. A fallboard opens and closes a performance section. Arms have respective guide grooves for guiding sliding of the fallboard in a front-rear direction. Left and right side plates are provided for left and right ends of a front portion of the fallboard, and have shield walls for shielding areas around left and right end faces of the fallboard, respectively. Left and right guide bushes protrude outward from the side plates, for engagement with the guide grooves of the respective arms. The guide bushes are guided by the guide grooves of the respective arms during sliding of the fallboard in the front-rear direction.

13 Claims, 5 Drawing Sheets

FALLBOARD ARRANGEMENT FOR KEYBOARD INSTRUMENT

CROSS-REFERENCE TO RELATED APPLICATION

This application claims priority to and the benefit of Japanese Patent Application Number 100268/2012, filed on Apr. 25, 2012, the entire disclosure of which is incorporated herein by reference.

BACKGROUND OF THE INVENTION

1. Field of the Invention

The present invention relates to a fallboard arrangement for a keyboard instrument, which is capable of opening and closing a performance section of the keyboard instrument by sliding a fallboard of the keyboard instrument.

2. Description of the Related Art

Conventionally, as a fallboard arrangement for a keyboard instrument, there has been known one disclosed e.g. in Japanese Laid-Open Patent Publication (Kokai) No. 2000-305556. The fallboard arrangement is applied to an electronic piano, and includes a fallboard. The fallboard is mounted on the piano body of the electronic piano such that it can slide in a front-rear direction between a closed position for closing a performance section of the electronic piano and an open position for opening the same. The fallboard has a laterally elongated fallboard front section secured to the front end thereof with screws, and left and right front guide protrusions protruding from the lower end of the fallboard front section. The front guide protrusions protrude outward from the respective left and right ends of the fallboard front section, and are engaged with front guide grooves of respective left and right arms of the piano body.

Further, the fallboard has a laterally elongated fallboard rear section secured to the rear end thereof with screws, and left and right rear guide protrusions and left and right pinions protruding from the fallboard rear section. The left and right pinions protrude outward from the respective left and right ends of the fallboard rear section, and are in mesh with racks of the respective left and right arms of the piano body. The left and right rear guide protrusions protrude further outward than the left and right pinions, and are engaged with rear guide grooves of the respective left and right arms of the piano body.

With the above-described arrangement, in the fallboard arrangement, when the fallboard is manually drawn forward or pushed rearward, the front guide protrusions are guided by the respective front guide grooves, and the rear guide protrusions are guided by the respective rear guide grooves, while the pinions rotate in mesh with the respective racks. Thus, the fallboard slides in the front-rear direction while preventing large gaps from being formed between the upper edges of the respective arms and the associated lower edges of the fallboard during sliding of the fallboard. This is because if such gaps are formed, the appearance of the electronic piano is degraded, and there is a fear that smooth sliding of the fallboard can be hindered due to entrance of foreign matter into the gaps.

As described above, according to the fallboard arrangement disclosed in Japanese Laid-Open Patent Publication (Kokai) No. 2000-305556, with a view to ensuring good appearance and smooth opening and closing operation, it is required to prevent large gaps from being formed between the upper edges of the respective arms and the lower edge of the fallboard during sliding of the fallboard in the front-rear direction. For this reason, the upper edges of the arms and the front guide grooves are limited in positional relationship therebetween and shape, which results in a low degree of freedom of design.

SUMMARY OF THE INVENTION

It is an object of the present invention to provide a fallboard arrangement for a keyboard instrument, which includes a slide-type fallboard and makes it possible to enhance the degree of freedom of design while ensuring good appearance and smooth opening and closing operation of the fallboard, to thereby improve the marketability of the keyboard instrument.

To attain the above object, the present invention provides a fallboard arrangement for a keyboard instrument, for opening and closing a performance section including a keyboard disposed within an instrument body, by being slid in a front-rear direction, comprising a fallboard mounted to the instrument body, for opening and closing the performance section, a pair of left and right arms provided in the instrument body such that the pair of left and right arms extend in the front-rear direction at locations outward of respective left and right ends of the fallboard, the pair of left and right arms having respective guide grooves for guiding sliding of the fallboard in a front-rear direction, a pair of left and right shield members provided for the respective left and right ends of the fallboard such that the pair of left and right shield members extend downward from the fallboard, the pair of left and right shield members having respective shield walls for shielding areas around respective left and right end faces of the fallboard, respectively, and a pair of left and right protruding members protruding outward from the shield walls of the pair of left and right shield members, respectively, for engagement with the guide grooves of the pair of left and right arms, the protruding members being guided by the guide grooves of the pair of left and right arms during sliding of the fallboard in the front-rear direction.

According to this fallboard arrangement for a keyboard instrument, the pair of left and right protruding members are guided by the guide grooves of the pair of left and right arms, respectively, whereby the fallboard slides in the front-rear direction. During the above-described opening and closing operation of the fallboard, even if gaps may be formed between the lower edges of the fallboard and the upper edges of the respective arms due to the positional relationship between the arms and the respective associated guide grooves and the shapes of the arms and the guide grooves, the gaps can be shielded by the respective shield walls since each of the left and right shield members fixed to the respective left and right ends of the front portion of the fallboard has the shield wall extending downward from the fallboard in a manner shielding an area around an associated one of the left and right end faces of the fallboard. This makes it possible to enhance the degree of freedom of design while maintaining excellence in the appearance of the fallboard and smooth opening and closing operation of the same, to thereby improve the marketability of the product.

Preferably, each of the pair of left and right protruding members is fixed to the fallboard via a fixing piece integrally with an associated one of the pair of left and right shield members.

With the arrangement of this preferred embodiment, it is possible to integrally fix each of the protruding members and an associated one of the shield members to the fallboard by using a single fixing piece. This makes it possible to reduce the number of assembly steps and the number of components in comparison with a case where each protruding member and an associated shield member are separately fixed to a fallboard via respective different fixing pieces, which contributes to reduction of manufacturing costs.

Preferably, each of the pair of left and right protruding members and an associated one of the pair of left and right shield members are integrally formed with each other.

With the arrangement of this preferred embodiment, each of the protruding members and an associated one of the shield members are integrally formed therewith, so that it is possible to reduce the number of components in comparison with a case where each protruding member and an associated shield member are separately formed, which contributes to reduction of manufacturing costs.

Preferably, the fallboard further comprises a fallboard front section provided at a front end of the fallboard such that the fallboard front section extends in a left-right direction, and the pair of left and right shield members are fixed to the fallboard in a manner shielding left and right sides of the fallboard front section, respectively.

With the arrangement of this preferred embodiment, the shield members are fixed to the fallboard in a manner shielding the respective left and right sides of the fallboard front section, so that even when the left and right sides of the fallboard front section reach locations above the upper edges of the respective left and right arms during sliding of the fallboard in the front-rear direction, it is possible to shield the left and right sides of the fallboard front section by the respective shield walls. Thus, even when the fallboard is provided with the fallboard front section, it is possible to enhance the degree of freedom of design while maintaining excellence in the appearance of the fallboard and smooth opening and closing operation of the same, to thereby improve marketability of the product.

Preferably, the shield members are made of a synthetic resin material.

In a case where a pair of shield members are provided for respective left and right ends of the front portion of the fallboard, if the shield members are made of a hard material, such as a metal, there is a fear that the surfaces of the respective arms can be scratched due to contact between the shield members and the arms during sliding of the fallboard. With the arrangement of this preferred embodiment, since the shield members are made of a synthetic resin, it is possible to suppress scratches from being made on the surfaces of the respective arms in comparison with the case where the shield members are made of a hard material, such as a metal, and therefore the marketability of the product can be further improved. In the case of the fallboard arrangement as recited in appended claim 4, since the pair of shield members are fixed to the fallboard in a manner shielding the respective left and right sides of the fallboard front section, even if the fallboard front section is made of a hard material, such as a metal, it is possible to prevent the surfaces of the respective arms from being scratched, and therefore the degree of freedom of design and the marketability of the product can be further improved.

The above and other objects, features, and advantages of the present invention will become more apparent from the following detailed description taken in conjunction with the accompanying drawings.

DETAILED DESCRIPTION OF PREFERRED EMBODIMENTS

Figure 1:
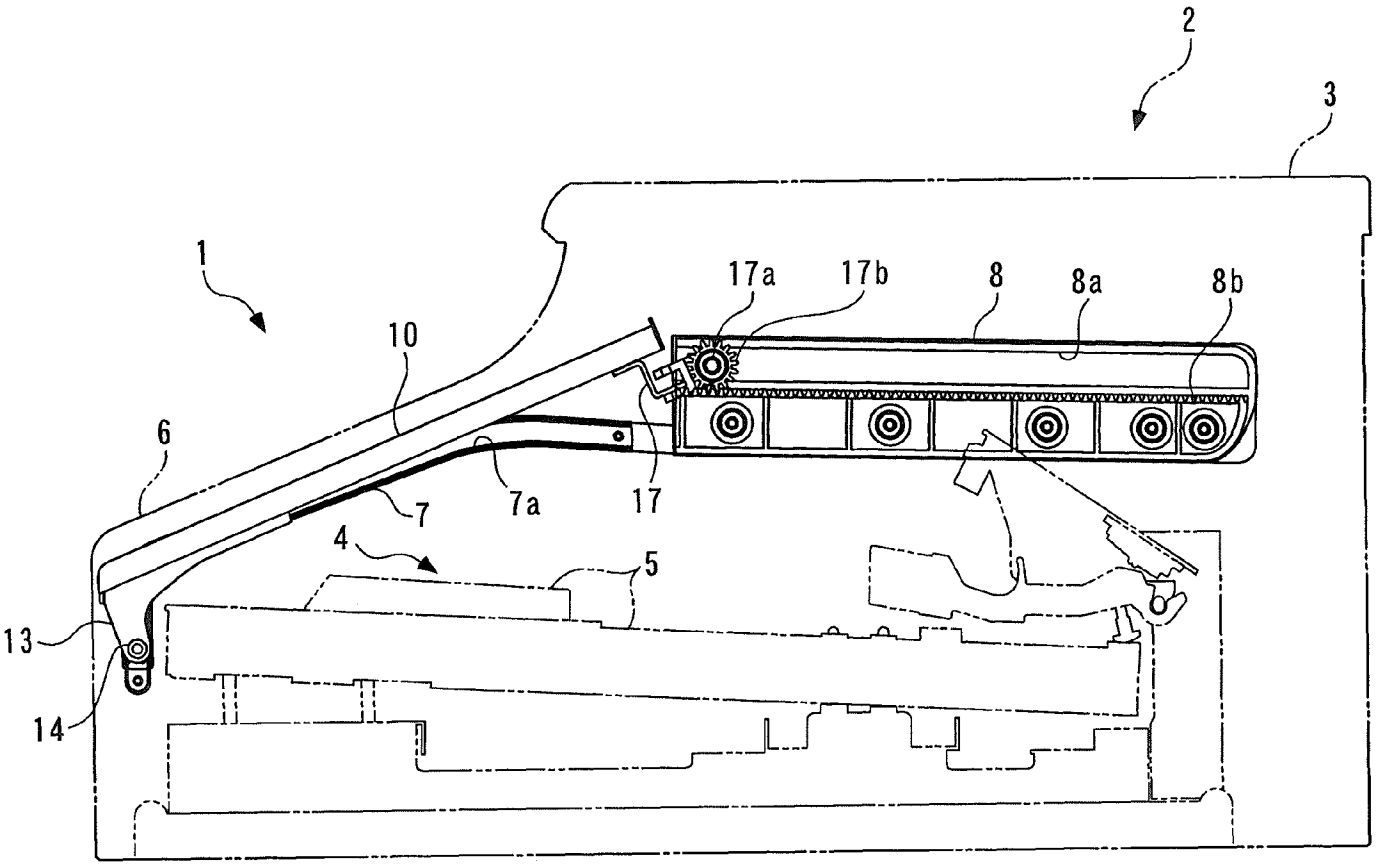
FIG. 1 is a side transparent view of an electronic piano including a fallboard arrangement according to an embodiment of the present invention with a fallboard in a closed position.

The present invention will now be described in detail with reference to the drawings showing a preferred embodiment thereof. FIG. 1 shows a fallboard arrangement 1 for a keyboard instrument, according to the embodiment of the present invention. As shown in FIG. 1, the fallboard arrangement 1 of the present embodiment is applied to an electronic piano 2 as the keyboard instrument. The electronic piano 2 includes a piano body 3 (instrument body) and the fallboard arrangement 1 having a fallboard 10 for opening and closing a performance section 4 of the piano body 3. The piano body 3 is an assembly of plywood members, steel members, and so forth, and includes left and right arms 6 and 6 (only one of which is shown in FIG. 1) each extending in the front-rear direction. The arms 6 and 6 are formed by laminating a vinyl chloride sheet (or an olefin-based resin sheet) to the surface of a wood material, such as MDF material, and a keyboard 5 and an operation panel (not shown) are arranged in the performance section 4 between the arms 6 and 6.

Each of the left and right arms 6 and 6 has an inner surface thereof formed with front and rear grooves each extending in the front-rear direction, and a front guide rail 7 and a rear guide rail 8 are fitted in the front and rear grooves, respectively. The left and right front guide rails 7 and 7 (only one of which is shown) and the left and right rear guide rails 8 and 8 (only one of which is shown) are bilaterally symmetrically arranged.

Each of the front guide rails 7 extends vertically upward from the front end of the piano body 3 along the inner surface of the arm 6, then from the uppermost portion, extends obliquely upward and rearward toward the front end of the rear guide rail 8, and a rear end thereof extends slightly obliquely downward and rearward. Each of the front guide rails 7 is formed by a resin molded article having an inwardly open U-shape (not shown) in cross section. The open portion of each front guide rail 7 serves as a front guide groove 7*a* (guide groove). The front guide groove 7*a* extends over the whole length of the front guide rail 7 and has an open rear end. The front guide rail 7 is secured to the arm 6 with screws such that the inner end thereof is flush with the inner surface of the arm 6.

Each of the rear guide rails 8 is secured to the arm 6 with screws in a manner extending over a long distance in the front-rear direction, and is formed with a rear guide groove 8*a* and a rack 8*b*. The rear guide groove 8*a* and the rack 8*b* are arranged parallel to each other in the mentioned order from the outside and are integrally formed with each other. Further, the rear guide groove 8*a* and the rack 8*b* each extend over the whole length of the rear guide rail 8 in the front-rear direction. The rear guide groove 8*a* is rectangular in cross section (not shown) and open inwardly. The rack 8*b* is disposed at a location slightly downward of the bottom surface of the rear guide groove 8*a*.

Figure 2:
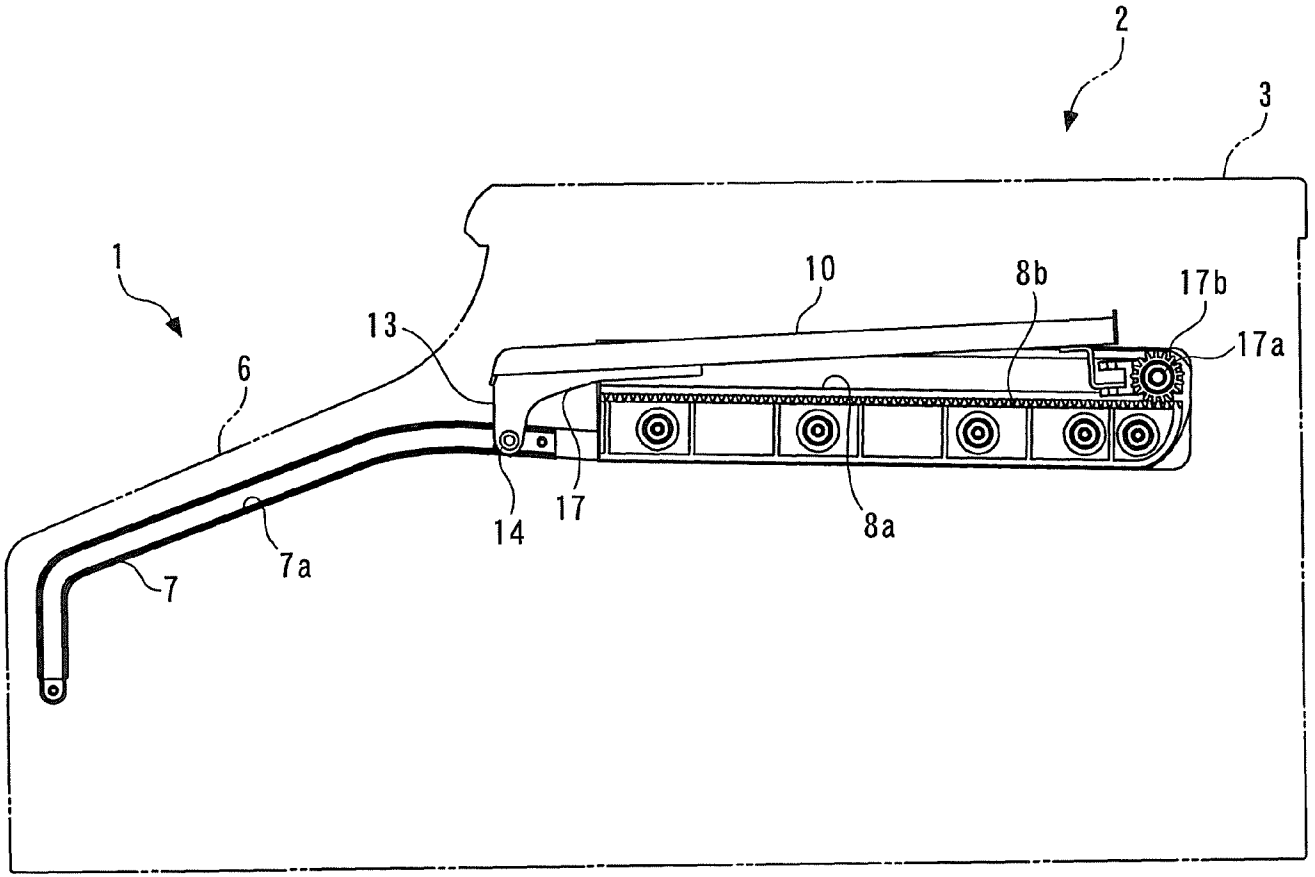
FIG. 2 is a side transparent view of the electronic piano with the fallboard in an open position.
Figure 3:
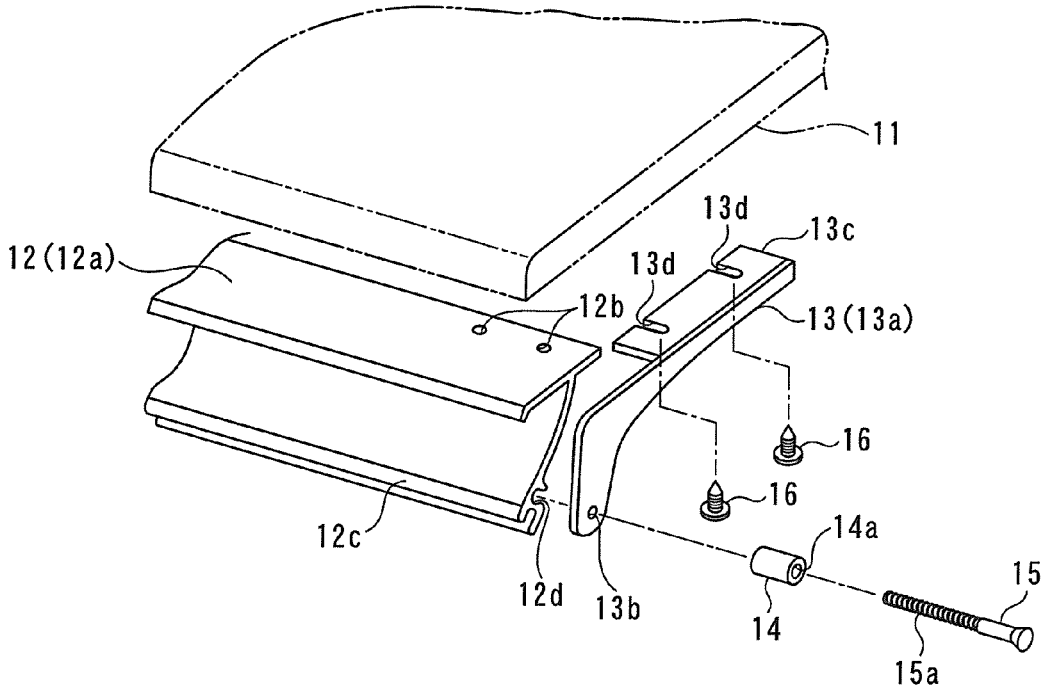
FIG. 3 is an exploded perspective view of a side plate and component parts associated therewith.
Figure 4:
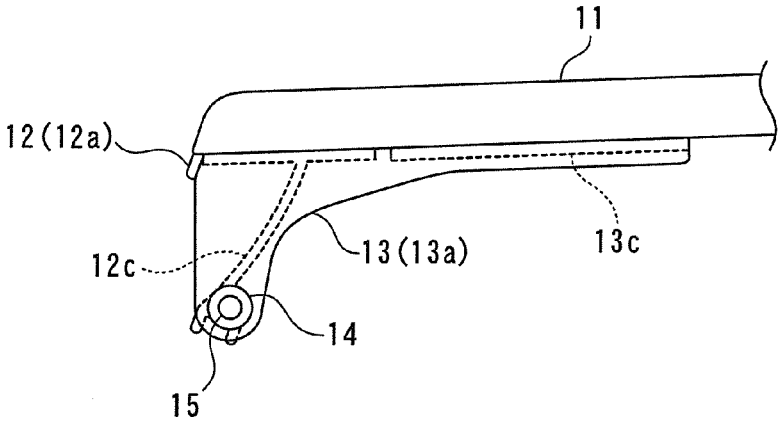
FIG. 4 is a side view of the side plate and component parts associated therewith.

The fallboard 10 is mounted on the piano body 3 such that it can slide in a front-rear direction between a closed position for closing the performance section 4 as illustrated in FIG. 1 and an open position for opening the same as illustrated in FIG. 2. As shown in FIGS. 3 and 4, the fallboard 10 includes a fallboard main section 11, a fallboard front section 12, left and right side plates 13 and 13 (only one of which is shown), left and right guide bushes 14 and 14 (only one of which is shown), and left and right fixing pins 15 and 15 (only one of which is shown). The fallboard main section 11 is formed by a laterally elongated rectangular plate (e.g. an MDF material having a vinyl chloride sheet or an olefin-based resin sheet laminated to a surface thereof). The fallboard main section 11 has a width slightly smaller than a distance between the inner surfaces of the respective left and right arms 6 and 6, and a depth which is large enough to cover the performance section 4 together with the fallboard front section 12.

The fallboard front section 12 is formed by an extrusion molded article of a light alloy (e.g. an aluminum alloy) and is mounted to the front end of the fallboard main section 11. The fallboard front section 12 comprises a flat base plate portion 12*a* and a mounting portion 12*c* extending obliquely downward from the base plate portion 12*a*. The base plate portion 12*a* is formed with a plurality of round holes 12*b* (only two of which are shown). The base plate portion 12*a* is rigidly secured to the fallboard main section 11 in a state in contact with the lower surface thereof by inserting screws (not shown) through the respective round holes 12*b* and screwing the screws into the fallboard main section 11. The base plate portion 12*a* has a front end protruding obliquely forward and downward from the front end of the fallboard main section 11. The mounting portion 12*c* has a front end thereof formed with a fixing hole 12*d* having a C shape in cross section and extending over the whole length of the mounting portion 12*c* in the left-right direction.

Each of the left and right side plates 13 (shield members) is made of an ABS resin and has a flat side wall portion 13*a* and a flat upper wall portion 13*c*. The side wall portion 13*a* (shield wall) extends in the front-rear direction, and has a downward protrusion height that is largest in the front portion of the side wall portion 13*a* and is progressively reduced rearward. The side wall portion 13*a* has a lower end thereof formed with a round hole 13*b*. The upper wall portion 13*c* extends inward from a portion of the side wall portion 13*a* extending from a central portion thereof to the rear end thereof, and is formed with two laterally elongated cutout holes 13*d* and 13*d*. The upper wall portion 13*c* is rigidly secured to the fallboard main section 11 in a state in contact with the lower surface thereof by inserting screws 16 through the respective cutout holes 13*d* and screwing the screws into the fallboard main section 11. In this state, the side wall portions 13*a* of the respective side plates 13 shield the left and right opposite sides of the fallboard front section 12, respectively.

Each of the left and right guide bushes 14 (protruding members) is made of a synthetic resin and has a hollow cylindrical shape. The guide bushes 14 are fixed to the fallboard front section 12 by the respective left and right fixing pins 15 (fixing pieces). The guide bushes 14 protrude outward from the side wall portions 13*a* of the respective side plates 13 for engagement with the front guide grooves 7*a* of the respective front guide rails 7. Each of the fixing pins 15 has a tapping screw-type screw portion 15*a* extending from a central portion thereof to a tip end thereof. The screw portion 15*a* is screwed into the fixing hole 12*d* of the fallboard front section 12 through an inner hole 14*a* of the associated guide bush 14 and the round hole 13*b* of the associated side plate 13, whereby the guide bush 14 is fixed to the fallboard front section 12 integrally with the side plate 13.

As shown in FIGS. 1 and 2, a fallboard rear section 17 is mounted to the rear end of the fallboard main section 11. The fallboard rear section 17 is formed by bending a metal plate (e.g. a steel plate), and is secured to the fallboard main section 11 in a state in contact with the lower surface of the same with screws. The fallboard rear section 17 has a rotary shaft 17*a* rotatably mounted thereto. The rotary shaft 17*a* extends in the left-right direction, and opposite ends thereof function as engaging portions for engagement with the rear guide grooves 8*a* and 8*a* of the respective rear guide rails. Further, a portion of the rotary shaft 17*a* inward of the left and right engaging portions has left and right pinions 17*b* and 17*b* (only one of which is shown) integrally formed therewith. The pinions 17*b* and 17*b* are in mesh with the racks 8*b* and 8*b* of the respective left and right rear guide rails.

In the fallboard arrangement 1 constructed as above, when the fallboard 10 is to be opened, the fallboard 10 in the closed position is pushed rearward while being lifted upward. In accordance with this operation, the engaging portions of the respective guide bushes 14 and those of the rotary shaft 17*a* are guided by the respective front and rear guide grooves 7*a* and 8*a*, and the pinions 17*b* are rotated in mesh with the respective racks 8*b*, whereby the fallboard 10 is slid rearward and opened. On the other hand, when the fallboard 10 is to be closed, the fallboard 10 in the open position is drawn forward. In accordance with this operation, the engaging portions of the respective guide bushes 14 and those of the rotary shaft 17*a* are guided by the respective front and rear guide grooves 7*a* and 8*a*, and the pinions 17*b* are rotated in mesh with the respective racks 8*b*, whereby the fallboard 10 is slid forward and closed.

Figure 5:
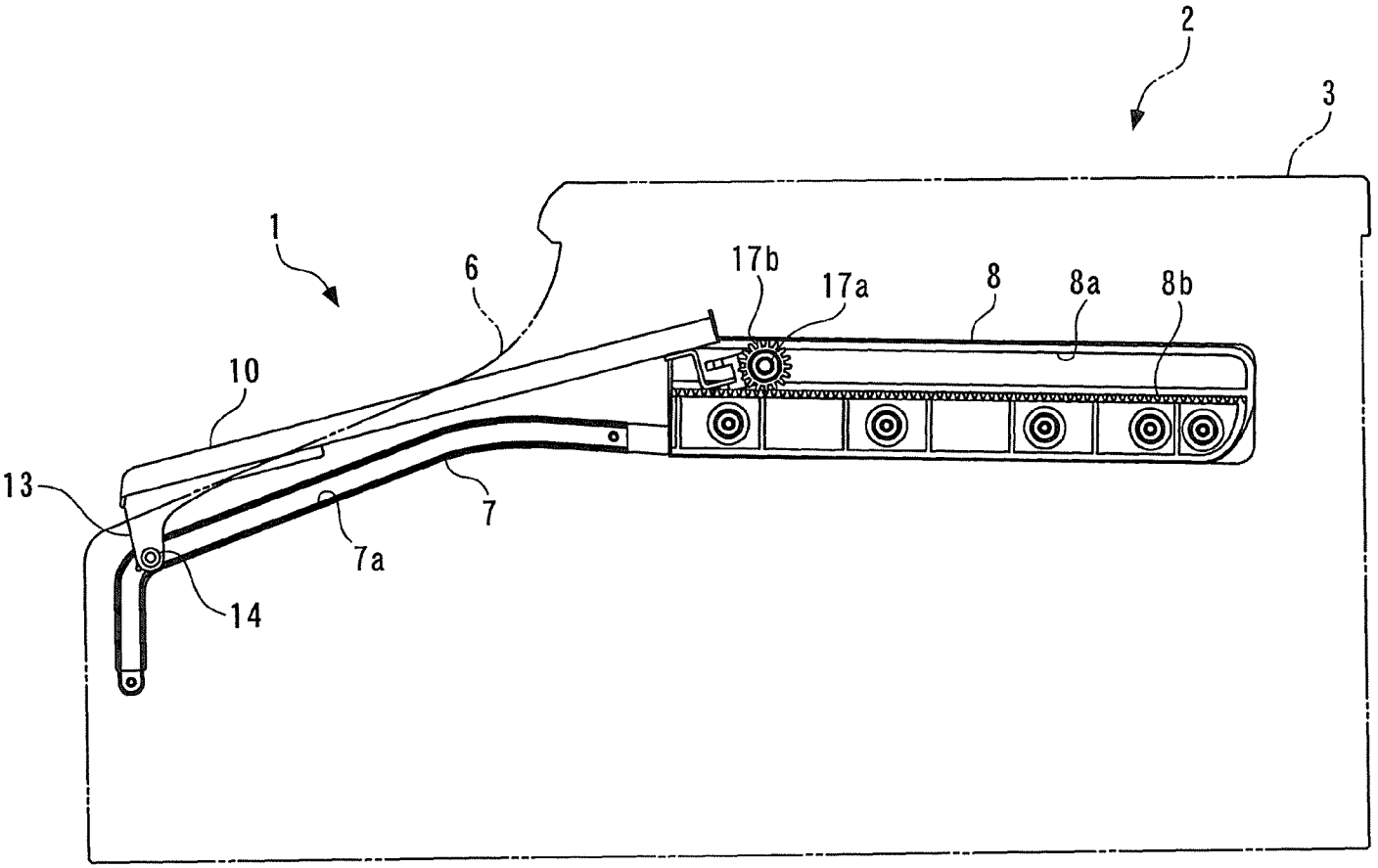
FIG. 5 is a side transparent view of the fallboard in a position between the closed position and the open position.
Figure 6:
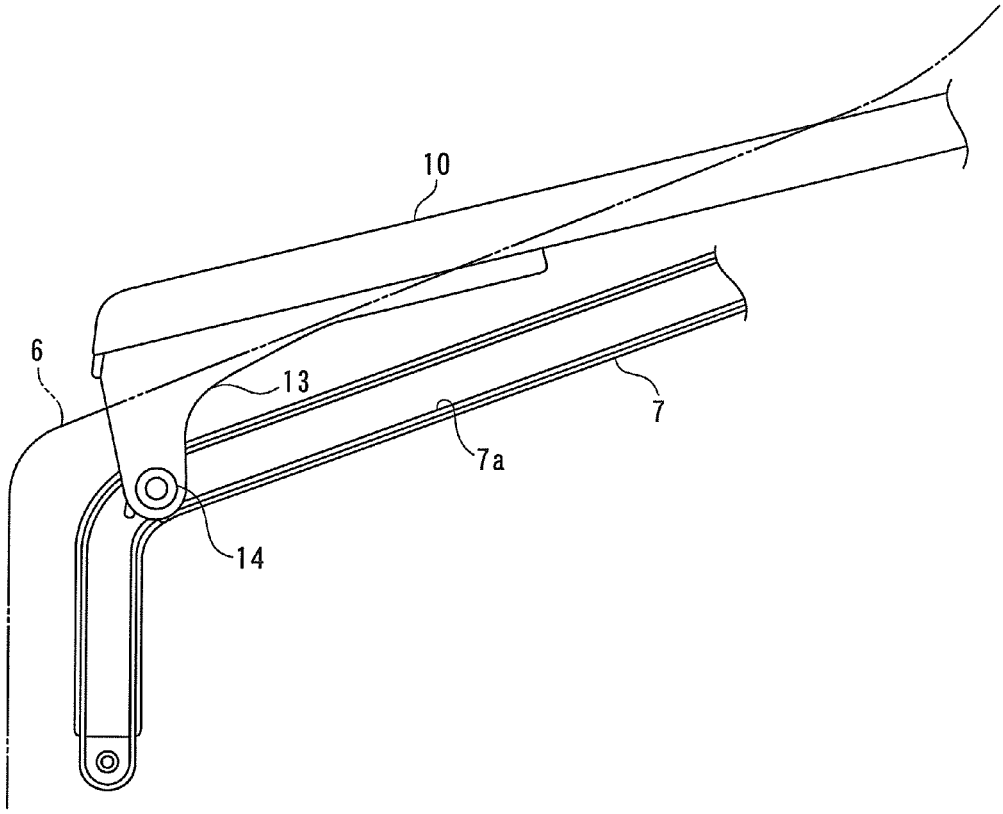
FIG. 6 is an enlarged view of the side plate and component parts associated therewith appearing in FIG. 5.

In the fallboard arrangement 1 of the present embodiment, during the above-described opening and closing operation of the fallboard 10, gaps are formed between the lower edges of the fallboard main section 11 and the upper edges of the arms 6 on the respective opposite left and right sides of the fallboard 10 as shown in FIGS. 5 and 6, but it is possible to shield the gaps by the respective side plates 13. In addition to this, the left and right side plates 13 and 13 are fixed to the fallboard main section 11 in a manner shielding the opposite left and right sides of the fallboard front section 12, so that even when each of the opposite left and right sides of the fallboard front section 12 reaches a position above the upper edge of the associated arm 6 during sliding of the fallboard 10 in the front-rear direction, the opposite left and right sides of the fallboard front section 12 can be shielded by the respective two side plates 13 and 13. This makes it possible to enhance the degree of freedom of design while maintaining excellence in the appearance of the fallboard and smoothness in the opening/closing operation of the same, to thereby improve the marketability of the product.

Further, it is possible to integrally fix each of the side plates 13 and an associated one of the guide bushes 14 to the fallboard main section 11 simply by using a single fixing pin 15. This makes it possible to reduce the number of assembly steps and the number of components in comparison with a case where the side plate 13 and the guide bush 14 are separately fixed to the fallboard main section 11 via respective different fixing pieces, which contributes to reduction of manufacturing costs.

Further, since the side plate 13 is made of the ABS resin, it is possible to suppress the surface (inner surface) of the arm 6 from being scratched in comparison with a case where the side plate 13 is made of a hard material, such as a metal. In addition, the side plates 13 are fixed to the fallboard main section 11 in a manner shielding the left and right opposite sides of the fallboard front section 12, so that even though a metal fallboard front section 12 is used, it is possible to prevent the surface of the arm 6 from being scratched, thereby further improving the degree of freedom of design and the marketability of the product.

Although in the present embodiment, the fallboard arrangement of the present invention is applied to the electronic piano 2 as a keyboard instrument, this is not limitative, but the present invention is applicable to various kinds of keyboard instruments. For example, the fallboard arrangement of the present invention may be applied to an electronic organ, a synthesizer, and the like.

Further, although in the present embodiment, the side plates 13 are used as the shield members, this is not limitative, but any other shield member may be used insofar as the member has a shield wall for shielding an area around each of the left and right end faces of the fallboard.

Although in the present embodiment, the shield members made of the ABS resin as the shield members, the material of each shield member is not limited to the ABS resin, but any other synthetic resin may be used. For example, it is possible to use an ASA resin, an ACS resin, or an AES resin to form the shield member.

Although in the present embodiment, the guide bush 14 is used as a protruding member, this is not limitative, but any suitable protruding member may be used insofar as it is configured to protrude outward from the shield wall of the shield member to be engaged with the guide groove of the arm such that the member can be guided by the guide groove of the arm when the fallboard slides in the front-rear direction.

Although in the present embodiment, the fixing pin 15 is used as a fixing piece, this is not limitative, but any suitable fixing piece may be used insofar as it is capable of integrally fixing the protruding member and the shield member to the fallboard.

Although in the present embodiment, the side plate 13 and the guide bush 14 are configured to be separate components, this is not limitative, but the side plate 13 and the guide bush 14 may be integrally molded into a one-piece product.

It is further understood by those skilled in the art that the foregoing is a preferred embodiment of the invention, and that various changes and modifications may be made without departing from the spirit and scope thereof.

What is claimed is:

1. A fallboard arrangement for a keyboard instrument, for opening and closing a performance section including a keyboard disposed within an instrument body, by being slid in a front-rear direction of the keyboard instrument, comprising:

a fallboard mounted to the instrument body for opening and closing the performance section, said fallboard having a right end, a left end, a front end and a back end, the front end provided at a front of the keyboard instrument and the back end provided at a back of the keyboard instrument;

a pair of left and right arms provided in the instrument body such that said pair of left and right arms extend in the front-rear direction at locations outward of respective left and right ends of said fallboard, said pair of left and right anus having respective guide grooves for guiding sliding of said fallboard in the front-rear direction;

a pair of left and right shield members provided at the front end of the fallboard for the respective left and right ends of said fallboard such that said pair of left and right shield members extend downward from said fallboard, said pair of left and right shield members having respective shield walls that shield areas under respective left and right ends of said fallboard at the front end of said fallboard; and a pair of left and right protruding members protruding outward from said shield walls of said pair of left and right shield members and provided at the front end of said fallboard, respectively, for engagement with the guide grooves of said pair of left and right arms, said protruding members being guided by the guide grooves of said pair of left and right arms during said sliding of said fallboard in the front-rear direction.

2. The fallboard arrangement according to claim 1, wherein each of said pair of left and right protruding members is fixed to said tailboard via a fixing piece integrally with an associated one of said pair of left and right shield members.

3. The fallboard arrangement according to claim 1, wherein each of said pair of left and right protruding members and an associated one of said pair of left and right shield members are integrally formed with each other.

4. The fallboard arrangement according to claim 1, further comprising a fallboard front section provided at a front end of said fallboard such that said fallboard front section extends in a left-right direction, and wherein said pair of left and right shield members are fixed to said fallboard in a manner shielding left and right sides of said tailboard front section, respectively.

5. The tailboard arrangement according to claim 2, further comprising a tailboard front section provided at a front end of said tailboard such that said fallboard front section extends in a left-right direction, and wherein said pair of left and right shield members are fixed to said tailboard in a manner shielding left and right sides of said fallboard front section, respectively.

6. The tailboard arrangement according to claim 3, further comprising a fallboard front section provided at a front end of said fallboard such that said fallboard front section extends in a left-right direction, and wherein said pair of left and right shield members are fixed to said fallboard in a manner shielding left and right sides of said fallboard front section, respectively.

7. The fallboard arrangement according to claim 1, wherein said shield members are made of a synthetic resin material.

8. The fallboard arrangement according to claim 2, wherein said shield members are made of a synthetic resin material.

9. The fallboard arrangement according to claim 3, wherein said shield members are made of a synthetic resin material.

10. The fallboard arrangement according to claim 4, wherein said shield members are made of a synthetic resin material.

11. The fallboard arrangement according to claim 5, wherein said shield members are made of a synthetic resin material.

12. The fallboard arrangement according to claim 6, wherein said shield members are made of a synthetic resin material.

13. The fallboard arrangement according to claim 1, wherein each of said shield walls extend in the front-rear direction and has a downward protrusion height that is largest in a front portion and is progressively reduced rearward.

* * * * *